United States Patent [19]

Mitsuya et al.

[11] Patent Number: 4,959,693

[45] Date of Patent: Sep. 25, 1990

[54] DUPLEX REPRODUCING APPARATUS WITH DEVICE FOR COOLING AND CONVEYING FUSED TONER IMAGE

[75] Inventors: Teruaki Mitsuya, Katsuta; Takao Kumasaka, Takahagi; Takao Umeda, Mito; Yasuro Hori, Katsuta; Ikuo Shimokobe, Katsuta; Nobuyoshi Hoshi, Katsuta, all of Japan

[73] Assignees: Hitachi, Ltd.; Hitachi Koki Co., Ltd., both of Tokyo, Japan

[21] Appl. No.: 266,842

[22] Filed: Nov. 3, 1988

[30] Foreign Application Priority Data

Nov. 10, 1987 [JP] Japan ..... 62-282179

[51] Int. Cl.[5] ..... G03G 15/20

[52] U.S. Cl. ..... 355/290; 219/216; 355/285; 355/312; 355/319

[58] Field of Search ..... 355/282, 285–291, 355/312, 319; 432/60; 219/216

[56] References Cited

U.S. PATENT DOCUMENTS

| | | | |
|---|---|---|---|
| 3,914,097 | 10/1975 | Wurl | 432/59 |
| 4,003,568 | 1/1977 | Stange et al. | 271/225 |
| 4,084,806 | 4/1978 | Wenthe et al. | 432/60 X |
| 4,212,529 | 7/1980 | O'Brien et al. | 355/312 X |
| 4,477,181 | 10/1984 | Neumann | 355/318 |
| 4,493,548 | 1/1985 | Ateya | 355/312 |
| 4,545,671 | 10/1985 | Anderson | 355/312 X |
| 4,668,073 | 5/1987 | Hatabe et al. | 355/282 X |
| 4,774,545 | 9/1988 | Tsuji et al. | 355/319 X |

*Primary Examiner*—A. T. Grimley
*Assistant Examiner*—Robert Beatty
*Attorney, Agent, or Firm*—Antonelli, Terry, Stout & Kraus

[57] ABSTRACT

An aerial recording sheet carrier is provided downstream of a fixing station. The aerial recording sheet carrier has one pair of pressure chambers with wall surfaces facing each other and in parallel. Air jets are arranged on opposite wall surfaces of the pressure chambers. A recording sheet and a toner image from the fixing station are carried by an air stream and cooled down. The toner image on the recording sheet, which is in fusion, is prevented from coming into contact with any parts, such as a recording sheet carrying passage. Thus a stain on parts due to contact with the toner image can be prevented.

9 Claims, 4 Drawing Sheets

DUPLEX REPRODUCING APPARATUS WITH DEVICE FOR COOLING AND CONVEYING FUSED TONER IMAGE

BACKGROUND OF THE INVENTION

The present invention relates to a duplex reproducing apparatus and, more particularly, to a duplex reproducing apparatus operating on an electro-photography principle. The present invention relates to a duplex reproducing apparatus preferable for printing both faces of a recording sheet comprising a cut paper.

A conventional duplex reproducing apparatus is disclosed in, for example, U.S. Pat. No. 4,588,281. Toner is used for developing images in this kind of duplex reproducing apparatus. FIG. 9 is a sectional side view typifying the conventional duplex reproducing apparatus.

The conventional duplex reproducing apparatus comprises a heat roll 1, a back-up roll 2, an image forming station which includes a photo sensitive drum 3, and a forward recording sheet carrying passage 4. A fixing station comprises mainly the heat roll 1 and the back-up roll 2.

The duplex reproducing apparatus comprises further an intermediate recording sheet carrying passage 5, an inversion recording sheet carrying passage 6, a backward recording sheet carrying passage 7 and a discharge recording sheet carrying passage 8. These recording sheet carrying passages 4, 5, 6, 7 and 8 are constituted mainly of a belt drive conveyor and a jam preventing iron plate which is provided at a seam between belt drive conveyors.

The duplex reproducing apparatus comprises an inversion claw 9, a recording sheet inlet 10, an inversion tray 11, and a discharge recording sheet stacking means 12.

A recording sheet 13 fed into the duplex reproducing apparatus from the recording sheet inlet 10 is conveyed to a an image forming station, where a toner image 14 is generated. The toner image 14 is present in this case on a lower surface of the recording sheet 13. Next, the recording sheet 13 is carried to the fixing station constituted mainly of the heat roll 1 and the back-up roll 2.

The heat roll 1 has a heater incorporated therein, which works as a heat source for heating the recording sheet 13. Then, while the back-up roll 2 is not provided with a heater, it is warmed up to a temperature high enough to fuse the toner image 14 as it presses functionally the recording sheet 13 being heated by the heat roll 1.

The toner generally does not have a definite fusing point and a definite solidifying point, however, the present invention refers to a temperature whereat the toner image 14 is capable of being transferred to other substances.

The recording sheet 13 is present under the forward recording sheet carrying passage 4 which is provided between the an image forming station and the fixing station (heat roll 1 and back-up roll 2), however, the recording sheet 13 is carried to the forward recording sheet carrying passage 4 on a suction of the air current. The recording sheet carrying method also applies likewise to the inversion recording sheet carrying passage 6 which will be described herein-later.

The recording sheet 13 having reached the fixing station is heated by the heat roll 1, thus the toner image 14 present on the lower surface of the recording sheet 13 is fused and then fixed on the recording sheet 13.

Next, the recording sheet 13 is carried to the inversion claw 9 through the intermediate recording sheet carrying passage 5. In this case the inversion claw 9 closes, if the recording sheet 13 necessary to have both sides printed, immediately before the recording sheet 13 reaches the inversion claw 9 with the one side printed. FIG. 9 shows the state where the inversion claw 9 has closed.

In the present invention the side of the recording sheet 13 which is printed first is called a first face, and the back side of the recording sheet 13 is called a second face. Upon closing of the inversion claw 9, the recording sheet 13 is fed into the inversion recording sheet carrying passage 6 and carried to the inversion tray 11. The first face of the recording sheet 13 comes upward in the inversion tray 11 according to the operation mentioned above.

Next, the recording sheet 13 is allowed into the backward recording sheet carrying passage 7, gets to the an image forming station by way of the backward recording sheet carrying passage 7 and the forward recording sheet carrying passage 4. The toner image 14 is thus generated on the second face of the recording sheet 13, and the then it is carried immediately before the inversion claw 9 as in the case of the first face fixing of the recording sheet 13.

In this case, the inversion claw 9 opens upward, and the recording sheet 13 having both face sides printed is discharged to the discharge recording sheet stacking means 12 by way of the discharge recording sheet carrying passage 8.

According to the series of operations described above, the toner image 14 is formed on both the first face and second face of the recording sheet 13 and then is fixed on the recording sheet 13.

Thus, the above stated construction and operation of the conventional duplex reproducing apparatus have been described with reference to the movement of one recording sheet 13. The recording sheet 13 used here is a cut paper. Further, the operation of the duplex reproducing apparatus is carried out sequentially.

A stain on parts such as the recording sheet carrying passages 4, 5, 6 and 7, the inversion claw 9 and others is not taken into consideration in the above described conventional duplex reproducing apparatus. The toner which is heated and fused by the fixing station is not cooled down thoroughly and comes in contact with the parts such as the recording sheet carrying passages 4, 5, 6 and 7, the inversion claw 9 and others as fused, thus staining the recording sheet carrying passages 4, 5, 6 and 7.

Consequently, in the conventional duplex reproducing apparatus shown in FIG. 9, a known method is such that the recording sheet 13 is carried on a lower side of the intermediate recording sheet carrying passage 5, and the face of the recording sheet 13 in contact with the back-up roll 2 is brought into contact with the intermediate recording sheet carrying passage 5.

However, the back-up roll 2 is also heated by the heat roll 1 up to a temperature high enough to fuse the toner. Thus, the toner image 14 on the first face of the recording sheet, 13 is refused by the back-up roll 2 at the time of the second face fixing of the recording sheet 13.

Therefore, even when employing such a recording sheet carrying method, the toner comes in contact with the recording sheet carrying passages 4, 5, 6 and 7 as fused and stains the recording sheet carrying passages 4, 5, 6 and 7, which is problematical.

Besides, the above problem may be present even in the case of a fixing method (flash fixing method, for example) other than that for which a heat roll is used, so far as the fixing method on heating is employed.

In case, for example, a long continuous paper is used like rotary printing, the above mentioned problem will be solved by retaining the continuous paper with tension, however, the problem is still not soluble in the conventional duplex reproducing apparatus, so far as cut paper is used as the recording sheet.

The problem of stain on the parts such as recording sheet carrying passage members and others in the cut paper printing is particularly influential in a duplex reproducing apparatus having high printing speed, because the higher the recording sheet carrying speed is, the longer the toner image is carried as fused.

SUMMARY OF THE INVENTION

An object of the present invention is to provide a duplex reproducing apparatus wherein stain on parts such as the recording sheet carrying passage and others due to contact of toner image in cut paper printing can be prevented from arising.

Another object of the present invention is to provide a duplex reproducing apparatus wherein a toner image in fusion can be prevented from coming into contact with any parts.

A further object of the present invention is to provide a duplex reproducing apparatus wherein a recording sheet and a toner image can be carried in the air.

A still further object of the present invention is to provide a duplex reproducing apparatus wherein a distance a recording sheet is carried while a toner image is fused can be shortened.

In accordance with the present invention, a duplex reproducing apparatus comprises an image forming station, a fixing station and an inversion recording sheet carrying passage, a toner image is generated on a first face of a recording sheet in the an image forming station, the toner image is fused and solidified and then fixed on the recording sheet in the fixing station, and the recording sheet turned over through the inversion recording sheet carrying passage is fed again into the image forming station thereafter to generate the toner image also on a second face of the recording sheet, which is fixed by the fixing station.

A support means for carrying the recording sheet from the fixing station supports the recording sheet out of contact with any solid members by an air stream until the toner image on the recording sheet is solidified.

In accordance with the present invention, an aerial recording sheet carrier is disposed between a fixing station and an inversion claw so as to carry the recording sheet from the fixing station while supporting the recording sheet out of contact with any solid members by an air stream until the toner image on the recording sheet is solidified.

According to the above mentioned duplex reproducing apparatus construction, the toner image surface is out of contact with the solid members by an air current so of the problem that the recording sheet carrying members being stained by the toner is solved.

According to the duplex reproducing apparatus of the present invention, the distance the recording sheet is carried while the toner image is fused is shortened, and the recording sheet and the toner image can be carried in the air during this period of time. Therefore the toner image being fused will never be brought into contact with any parts, and thus an ensured effect is that a stain on the recording sheet carrying passage members and others due to a contact of the toner image can be prevented from arising.

DESCRIPTION OF THE INVENTION

Figure 1:
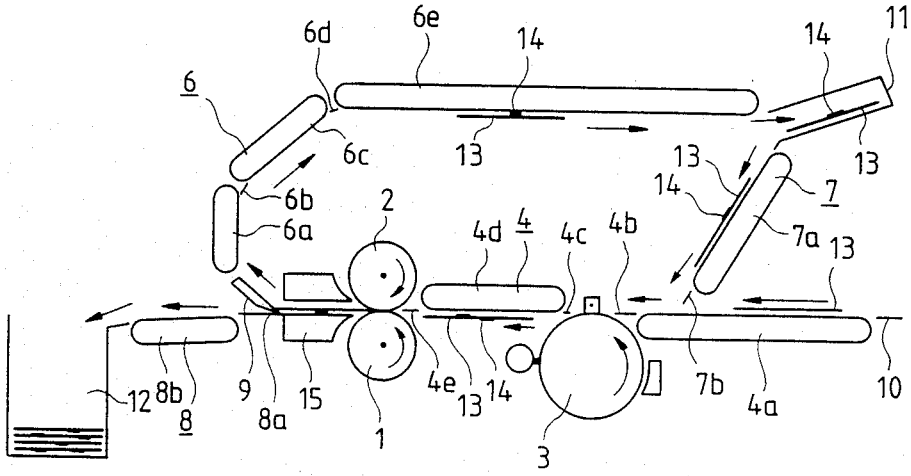
FIG. 1 is a sectional side view typifying a duplex reproducing apparatus according to one embodiment of the present invention.

One embodiment of the present invention will now be explained with reference to FIG. 1 to FIG. 3. FIG. 1 is a sectional side view showing an interior portion of a duplex reproducing apparatus according to one embodiment of the present invention.

The duplex reproducing apparatus comprises a heat roll 1, a back-up roll 2, an image forming station including a photosensitive drum 3 and a forward recording sheet carrying passage 4. A fixing station comprises the heat roll 1 and the back-up roll 2.

The duplex reproducing apparatus comprises further an inversion recording sheet carrying passage 6, a backward recording sheet carrying passage 7, and a discharge recording sheet carrying passage 8.

The an image forming station 3, the fixing station and the inversion recording sheet carrying passage 6 form a path for carrying a recording sheet 13 along outer enveloping surfaces thereof.

The forward recording sheet carrying passage 4, the inversion recording sheet carrying passage 6, the backward recording sheet carrying passage 7, and the discharge recording sheet carrying passage 8 are comprised mainly of a belt drive conveyor and a jam preventing iron plate which is provided at a seam between the belt drive conveyors.

The forward recording sheet carrying passage 4 comprises belt drive conveyors 4*a* and 4*d*, and iron plates 4*b*, 4*c* and 4*e*. The inversion recording sheet carrying passage 6 comprises belt drive conveyors 6*a*, 6*c* and 6*e*, and iron plates 6*b* and 6*d*. The backward recording sheet carrying passage 7 comprises a belt drive conveyor 7*a* and an iron plate 7*b*. The discharge recording sheet carrying passage 8 comprises an iron plate 8*a* and a belt drive conveyor 8*b*.

The duplex reproducing apparatus comprises further an inversion claw 9, a recording sheet inlet 10, an inversion tray 11, a discharge recording sheet stacking means 12, and an aerial recording sheet carrier 15. The aerial recording sheet carrier 15 is disposed between the fixing station and the inversion claw 9.

Arrows given in the heat roll 1, the back-up roll 2 and the image forming station indicate the direction of rotation, and the other arrows indicate the direction in which the recording sheet 13 is carried.

The recording sheet 13 fed from the recording sheet inlet 10 is carried through the forward recording sheet carrying passage 4 to get to the image forming station, and has a toner image 14 generated on a first face of the recording sheet 13. The recording sheet 13 is then carried to the fixing station constituted mainly of the heat roll 1 and the back-up roll 2 through the next forward recording sheet carrying passage 4, where the first face of the recording sheet 13 is fixed.

The recording sheet 13 discharged from the fixing station is fed into the aerial recording sheet carrier 15 (described in detail herein-later with reference to FIG. 2) almost concurrently with discharge, and carried on an air current of the aerial recording sheet carrier 15. Meantime, the toner image 14 on the first face of the recording sheet 13 is cooled down, and the toner image 14 is thoroughly solidified on the recording sheet 13.

Then, the duplex reproducing apparatus of the above stated embodiment of the present invention is constructed so that a rear end of the recording sheet 13 will leave the fixing station as soon as a nose of the recording sheet 13 gets to the inversion claw 9.

Thus, while the nose of the recording sheet 13 is carried through the aerial recording sheet carrier 15, the overall surface will not be suspended in the air. Consequently, the recording sheet 13 can be carried stably through the aerial recording sheet carrier 15.

As in the case of the conventional duplex reproducing apparatus, the inversion claw 9 closes only when the recording sheet 13, which is to have the second face printed, arrives immediately before the inversion claw 9. Thus, the recording sheet 13 is allowed into the inversion recording sheet carrying passage 6, conveyed to the inversion tray 11 and is inverted. The inversion operation is exactly the same as conventional duplex reproducing apparatus.

Then, there is a portion where the recording sheet 13 is carried on a lower side or vertically in the direction of gravity present on the forward recording sheet carrying passage 4 and the inversion recording sheet carrying passage 6 between the image forming station and the fixing station, however, the recording sheet 13 is brought forward through the inversion recording sheet carrying passages 4 and 6 on a suction of the air current and so carried as in the case of the conventional duplex reproducing apparatus.

The recording sheet 13 having been inverted arrives at the imaging forming station by way of the backward recording sheet carrying passage 7, has the toner image 14 generated on the second face of the recording sheet 13 and is then fixed by the fixing station. In this case the toner image 14 on the first face of the recording sheet 13 which has already been fixed is also heated and fused by the back-up roll 2.

With both the first face and second face of the recording sheet 13 cooled, the recording sheet 13 is carried through the aerial recording sheet carrier 15, and when reaching the inversion claw 9, the toner image 14 on both sides is thoroughly solidified on the recording sheet 13. The inversion claw 9 opens when the recording sheet 13 is conveyed to immediately before the inversion claw 9, and the recording sheet 13 is conveyed to the discharge recording sheet stacking means 12 by way of the discharge recording sheet carrying passage 8.

Each part characterized by the present invention will be described in detail, next. FIG. 2 is a sectional side view of the fixing station, indicating a positional relation of the aerial recording sheet carrier 15.

The heat roll 1 is that for which a hollow roll of aluminum material is coated with Teflon film on the outer peripheral surface of the heat roll 1. Then, a core of the heat roll 1 is provided with a halogen lamp 16 as a heating unit. The back-up roll 2 comprises a silicone rubber layer and an inside iron core hollow roll.

An isolating claw 17 is intended for isolating the recording sheet 13 from a surface of the heat roll 1 when the recording sheet 13 is discharged. An oil felt 18 is intended for applying an oil for preventing an offset phenomenon wherein the fused toner sticks on the surface of the heat roll 1. The fixing station in this specification refers in a general term to all members relating to fixation.

Figure 2:
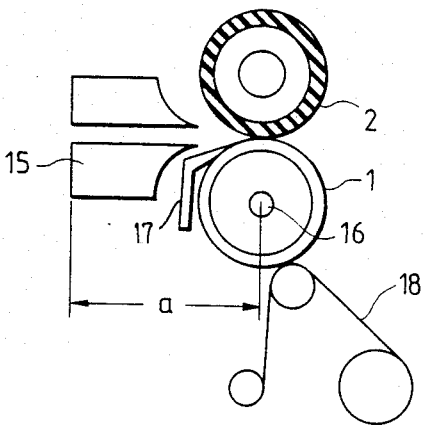
FIG. 2 is an explanatory view of a fixing station of a duplex reproducing apparatus according to one embodiment of the present invention.

The reference character "a" shown in FIG. 2 indicates a distance between the center of the heat roll 1 in the direction in which the recording sheet 13 is carried and the rear end of the aerial recording sheet carrier 15. The distance "a" will be described in detail herein-later.

Figure 3:
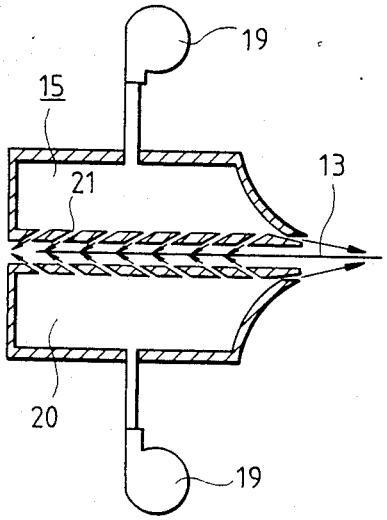
FIG. 3 is a sectional view typifying an aerial recording sheet carrier of a duplex reproducing apparatus according to one embodiment of the present invention.

FIG. 3 is a sectional side view of the aerial recording sheet carrier 15. Arrows in the drawing indicate the direction in which an air current blows through. The recording sheet 13 is carried from right to left in the drawing. An air current fed from a pair of blowers 19 is blown through a plurality of blow-through holes 21 through a pair of pressure chambers 20. The pair of pressure chambers 20 have wall surfaces facing in parallel with each other.

The rate of air flow through each blow-through hole 21 can thus be unified from each pressure chamber 20. The blow-through holes 21 act as air jet means and are arrayed zigzag at the same position vertically in the depth direction, and thus stable pressure can be provided onto the surface of the recording sheet 13 so as to hold the recording sheet 13 there-between.

The rearmost air flow in the direction in which the recording sheet 13 is carried is blown through slantingly rearward, however, to prevent a jam when the recording sheet 13 comes into a gap between the heat roll 1 and the back-up roll 2 and the aerial recording sheet carrier 15.

Other blow-through holes 21 have an inclination of 30° so as to blow through the air flow slantingly forward. This is effective in carrying the recording sheet 13 forward by providing a wall surface shearing force to the recording sheet 13 in the direction in which the recording sheet 13 runs. The recording sheet 13 is capable of running forward stably in the air according to construction and operation described as above.

Particularly in the above stated embodiment of the present invention, a rear portion of the recording sheet 13 is put between the heat roll 1 and the back-up roll 2 and a nose portion of the recording sheet 13 is present within the aerial recording sheet carrier 15. As a result a better stability will be ensured for the recording sheet carrying operation.

Described next is how to calculate the distance "a" from the heat roll center to the aerial recording sheet carrier nose portion shown in FIG. 2. In the embodiment of the present invention, it is designed such that the toner image 14 is solidified thoroughly on the recording sheet 13 while the surface of the recording sheet 13 is present within the aerial recording sheet carrier 15.

The solidifying temperature of the toner is experimentally 10° C. to 20° C. higher than a glass transition point of the toner. The glass transition point of the toner used in the embodiment of the present invention is 67° C. In the embodiment of the present invention, however, a solidifying temperature of the toner is set at 77° C. at lowest.

If a heat roll surface temperature is $T_H$ (°C.), a back-up roll surface temperature is $T_B$ (°C.), an air current temperature is $T_O$ (°C.), a time after the recording sheet is discharged from the fixing station is t(s), a heat transfer rate of the toner and the air current is h (kcal/m$^2$s°C.), a heat diffusion efficiency of the toner is K(m$^2$/s), a heat diffusion rate or the toner is $\lambda$ (kcal m$^2$/s), a distance from the blow-through hole outlet d (mm) is blow-through hole diameter to the recording sheet is H (mm), and an inclination of the blow-through hole is $\theta$ (°), a blow-through flow rate is U (m/s), and a recording sheet carrying velocity is $\gamma$ (m/s).

Then in the case of the duplex reproducing apparatus, $T_H$=170 (°C.), $T_B$=120 (°C.), $T_O$=20 (°C.), h=0.0977 (kcal/m$^2$s°C.), K=8.33×10$^{-8}$ (m$^2$/s), $\lambda$=2.22×10$^{-5}$ (kcal/m$^2$s°C.), d=2 (mm), H=8 (mm), $\theta$=30(°C.), U=20 (m/s), $\gamma$=0.5(m/s).

Here, from using the values d, H, $\theta$, U, the heat transfer rate h is estimated by an impinging jet flow empirical formula (reference: page 111, Heat Transfer Engineering, third revised edition, by Japan Society of Mechanical Engineers). Measured values are used for the toner heat diffusion efficiency K and the heat diffusion rate $\lambda$. Then, other values are design reference values of the embodiment of the present invention.

If the toner surface temperature is T (°C.), then the time change is indicated by the following equation.

Where heated on the heat roll 1:

$$T = (T_H - T_0) \cdot \mathrm{EXP}\left(\left(\frac{h}{\lambda}\right)^2 \cdot k \cdot t\right) \cdot \left(1 - erf\left(\frac{h}{\lambda} \cdot \sqrt{kt}\right)\right) + T_0 \quad (1)$$

Where heated on the back-up roll 2:

$$T = (T_B - T_0) \cdot \mathrm{EXP}\left(\left(\frac{h}{\lambda}\right)^2 \cdot k \cdot t\right) \cdot \left(1 - erf\left(\frac{h}{\lambda} \cdot \sqrt{kt}\right)\right) + T_0 \quad (2)$$

(Reference: Kensuke Kawashima's "Theory of Thermal Conduction", published by OHM-Sha, Ltd.)

From equation (1), the time for the surface temperature of the toner heated on the heat roll 1 to reach solidifying temperature of the toner is t=1 (s). Then, from equation (2), the time for the surface temperature of the toner heated on the back-up roll 2 to reach solidifying temperature of the toner is t=0.2 (s).

Since the time for cooling the surface temperature of, the toner heated on the heat roll 1 is longer, only the cooling of the surface temperature of the toner heated on the heat roll 1 may be considered in the case of the embodiment of the present invention.

Accordingly, the distance "a" from the heat roll center to the aerial recording sheet carrier nose portion will be indicated by the following equation with the time for surface temperature of the toner heated on the heat roll 1 to come down to solidifying temperature as $t_H$:

$$a = \gamma \cdot t_H \quad (3)$$

From equation (3), a=0.25 m. Here, the length of the recording sheet 13 in the carrying direction is 97 mm in the embodiment of the present invention. The length coincides with a distance from the center of the heat roll 1 to the inversion claw 9 which satisfies the condition that a rear end of the recording sheet 13 leaves the fixing station as soon as a front end of the recording sheet 13 reaches the inversion claw 9 as described with reference to FIG. 1. Accordingly, the aerial recording sheet carrier 15 can be contained properly in a space between the fixing station and the inversion claw 9.

According to an embodiment of the present invention, an effect is obtainable such that the surface temperature of the toner image 14 can be cooled down to the solidifying temperature of the toner while the toner image 14 is present within the aerial recording sheet carrier 15.

A further effect is that the recording sheet 13 can be carried with high stability, as the recording sheet 13 is kept between the heat roll 1 and the back-up roll 2 when a front end of the recording sheet 13 is present within the aerial recording sheet carrier 15, and blow-through holes 21 of the aerial recording sheet carrier 15 are arrayed zigzag at the same position vertically. Then, since a blow-through angle of the blow-through holes 21 of the aerial recording sheet carrier 15 has an inclination, a jam is prevented from arising and the recording sheet 13 is carried forward smoothly.

Figure 4A:
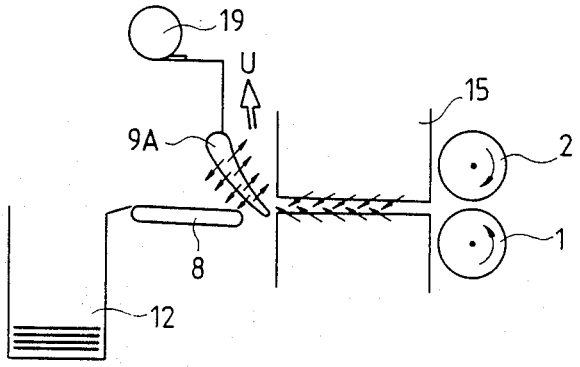
FIG. 4A is an explanatory view typifying an aerial recording sheet carrier, an inversion claw, and a discharge recording sheet carrying passage of a duplex reproducing apparatus according to another embodiment of the present invention and also shows a state where a recording sheet is inverted.
Figure 4B:
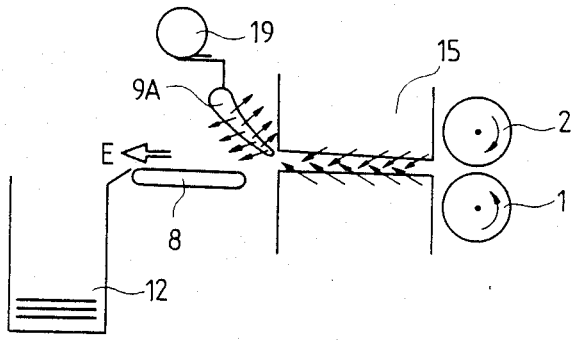
FIG. 4B is an explanatory view typifying an aerial recording sheet carrier, an inversion claw, and a discharge recording sheet carrying passage of a duplex reproducing apparatus according to another embodiment of the present invention and also shows a state where a recording sheet is discharged to a discharge recording sheet stacking means.

FIGS. 4A and 4B are explanatory views typifying another embodiment of the present invention which is a variation from the above described embodiment. An inversion claw 9A of the embodiment is supplied with a pressure air from the blower 19, and an air current comes out of air jet holes arrayed on a surface of the inversion claw 9A.

FIG. 4A shows a state where the recording sheet 13 is inverted, and FIG. 4B shows a state where the recording sheet 13 is discharged to the discharge recording sheet stacking means 12.

When air is sucked in through the wall surface of the inversion claw 9A as shown in FIG. 4A, the recording sheet (not indicated) is sucked accordingly and fed in the direction indicated by an arrow U. Then, when air is jetted from the wall surface of the inversion claw 9A as shown in FIG. 4B, the recording sheet (not indicated) is discharged to the discharge recording sheet stacking means 12 as indicated by an arrow E.

According to the above stated embodiment of the present invention, even where the toner has not yet been solidified perfectly at the point in time when it comes out of the aerial recording sheet carrier 15, the toner is not capable of sticking on the inversion claw 9A.

Figure 5A:
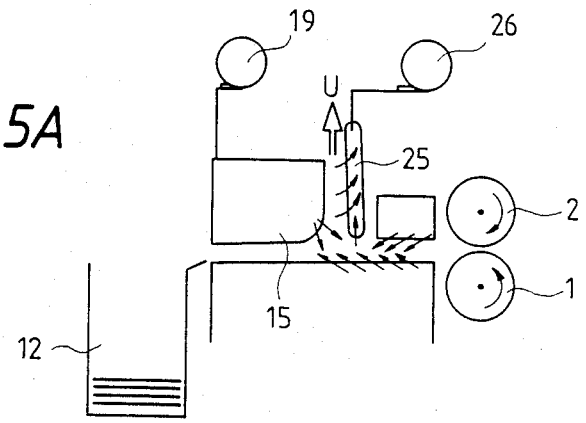
FIG. 5A is an explanatory view typifying an aerial recording sheet carrier, an inversion claw, and a discharge recording sheet carrying passage of a duplex reproducing apparatus according to a further embodiment of the present invention and also shows a state where a recording sheet is inverted.
Figure 5B:
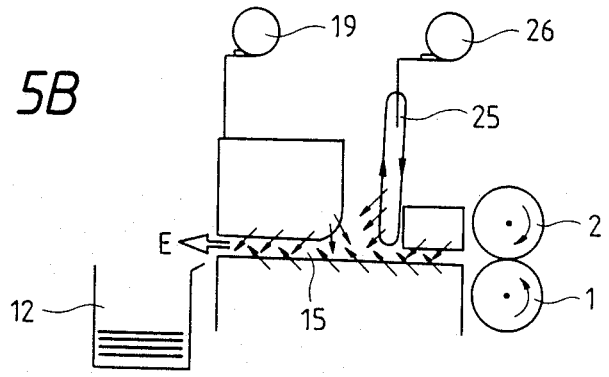
FIG. 5B is an explanatory view typifying an aerial recording sheet carrier, an inversion claw, and a discharge recording sheet carrying passage of a duplex reproducing apparatus according to a further embodiment of the present invention and also shows a state where a recording sheet is discharged to a discharge recording sheet stacking means.

A still further embodiment of the present invention is represented in FIGS. 5A and 5B, wherein FIG. 5A shows an inverted state of the recording sheet 13, and FIG. B shows a discharged state of the recording sheet 13.

Instead of the inversion claw 9A of the above stated embodiment, a carrier guide 25 is provided in the embodiment of the present invention. The carrier guide 25 has small holes for air jet and suction arrayed on the wall surface of the carrier guide 25, and is connected to a reversible blower 26.

When air is sucked in through the wall surface of the carrier guide 25 as shown in FIG. 5A, the recording sheet (not indicated) is sucked accordingly and fed in the direction indicated by an arrow U. Then, when air is jetted from the wall surface of the carrier guide 25 as shown in FIG. 5B, the recording sheet (not indicated) is discharged to the discharge recording sheet stacking means 12 as indicated by an arrow E.

Figure 6:
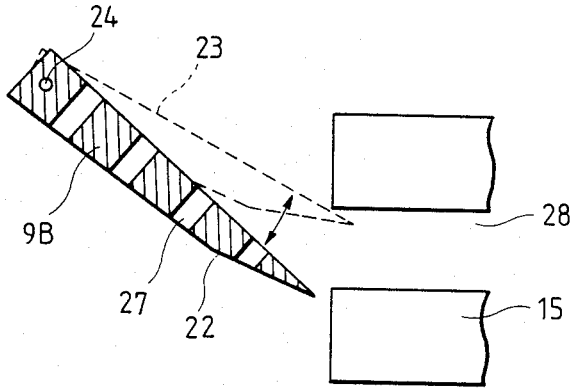
FIG. 6 is an explanatory view typifying an aerial recording sheet carrier and an inversion claw of a duplex reproducing apparatus according to one embodiment of the present invention.

FIG. 6 represents another embodiment of the present invention. An inversion claw 9B of this embodiment has a plurality of through holes 27 arrayed zigzag, and is reciprocated between an upper bound position 23 and a lower bound position 22.

The inversion claw 9B reciprocates around a shaft 24 between the lower bound position 22 and the upper bound position 23 according to the situation whether or not the recording sheet 13 is required to have the second face printed on the recording sheet 13.

In this case, a turbulent air flow is capable of resulting in a discharge recording sheet carrying passage 28 of the aerial recording sheet carrier 15, thus preventing a stable running of the recording sheet 13. Accordingly, the through holes 27 are provided on the inversion claw 9B in the embodiment of the present invention.

The inversion claw 9B of the embodiment is like a fan, so to speak, with many holes perforated therein, therefore its reciprocation between the upper bound position 23 and the lower bound position 22 does not disturb the air current of the nearby outlet of the discharge recording sheet carrying passage 28.

In the embodiment of the present invention shown in FIG. 6, if the inversion claw 9B is reciprocated at high speed, on the shaft 24, a force of inertia working at the upper bound and the lower bound positions 23 and 22 is capable of giving a large torsional stress to the shaft 24 leading to failure and deformation.

Figure 7:
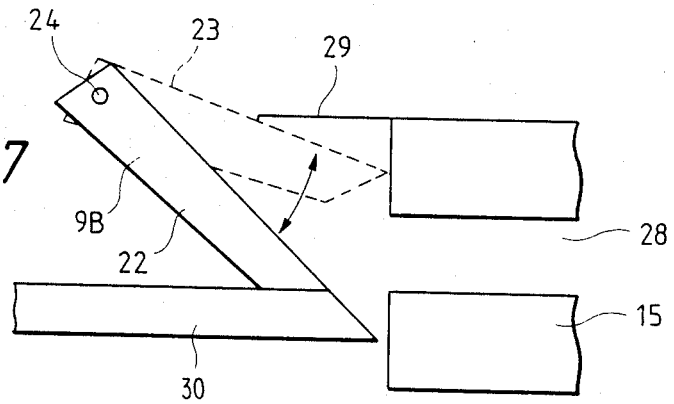
FIG. 7 is an explanatory view typifying an aerial recording sheet carrier and an inversion claw of a duplex reproducing apparatus according to another embodiment of the present invention.

Another embodiment of the present invention shown in FIG. 7 comprises providing an upper stopper plate 29 and a lower stopper plate 30 as stop members so as not to exert the above mentioned force of inertia on the shaft 24.

Figure 9:
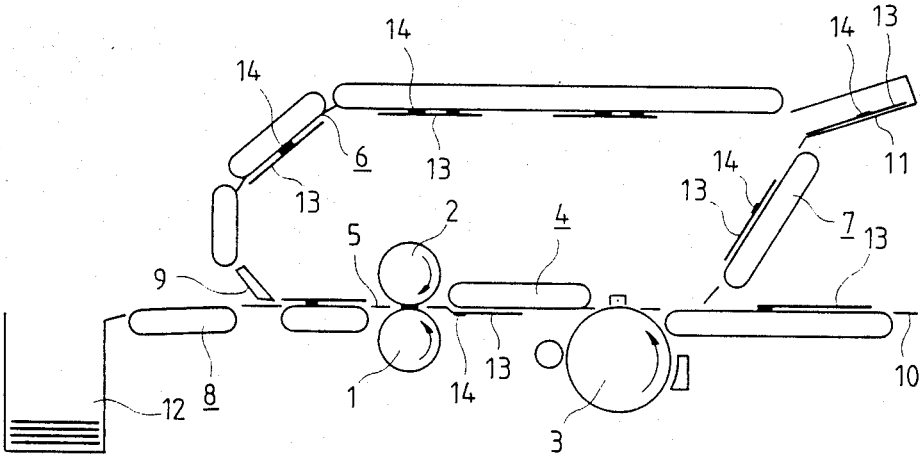
FIG. 9 PRIOR ART
FIG. 9 is a typical sectional view of a conventional duplex reproducing apparatus.

The lower stopper plate 30 in the embodiment shown in FIG. 7 functions as the discharge recording sheet carrying passage 8 shown in FIG. 9 at the same time. When the inversion claw 9*b* comes in contact with the lower stopper plate 30, an end surface of the lower stopper plate 30 on a side of the aerial recording sheet carrier 15 becomes perfectly even with an upper surface of the inversion claw 9*b*.

Thus, an effect ensured thereby is such that the recording sheet 13 will never be caught in a seam between the inversion claw 9*b* and the lower stopper plate 30, thus preventing a jam from arising.

Figure 8:
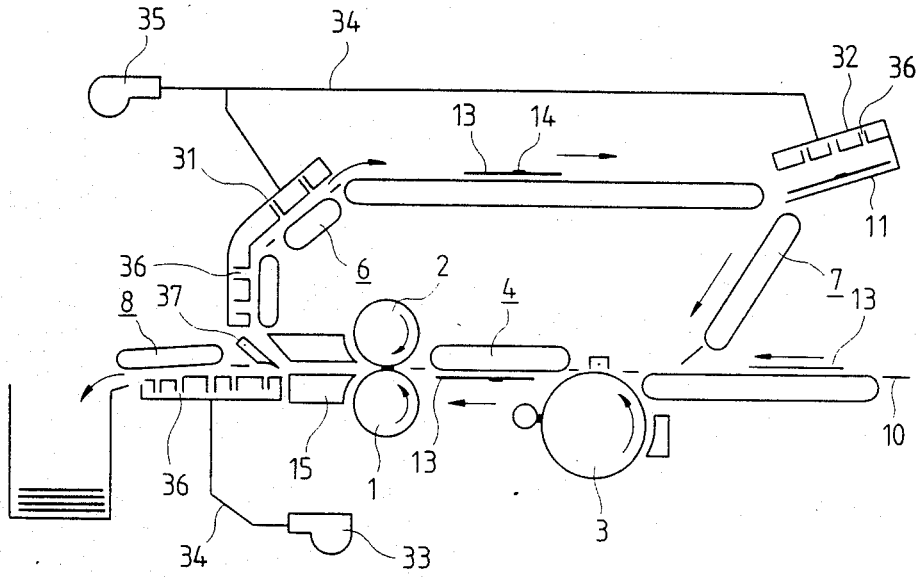
FIG. 8 is a sectional side view typifying a duplex reproducing apparatus according to another embodiment of the present invention.

FIG. 8 represents a further embodiment of the present invention. Points different from the embodiment shown in FIG. 1 of the present invention will be mentioned below.

(i) In the inversion recording sheet carrying passage 6, the recording sheet 13 is carried with the second face side free from the toner image 14 absorbed thereto. In such construction, when the recording sheet 13 passes the inversion claw 37 and through the inversion recording sheet carrying passage 6, the toner image 14 and the inversion recording sheet carrying passage 6 will never come in contact with each other, therefore a stain on the inversion recording sheet carrying passage 6 can be prevented as compared with the embodiment of FIG. 1.

(ii) Air jet devices 31, 32 and 33 are provided on the inversion recording sheet carrying passage 6, the inversion tray 11 and the discharge recording sheet carrying passage 8, respectively. The air jet devices 31, 32 and 33 are connected to a blower 35 through a piping 34, and blow the air over the toner image 14 through a plurality of jet holes 36.

Accordingly, the solidification of the toner image 14 on the recording sheet 13 is accelerated, and thus the toner image 14 on each of the recording sheets 13 will be prevented from sticking with each other particularly in the discharge recording sheet stacking means 12.

Further, the tightness of the recording sheet 13 with the guide surface in the inversion and the discharge recording sheet carrying passages 6 and 8 and the inversion tray 11 can be enhanced, therefore the recording sheet 13 can be carried smoothly, and an upper surface of the inversion tray 11 and the toner image 14 can be kept from coming in contact with each other, and thus a stain on the inversion tray 11 can be effectively prevented.

The air jet devices 31, 32 and 33 are effective when the recording sheet 13 is printed and carried particularly at high speed, therefore the air jet devices 31, 32 and 33 may not need to be installed where the printing rate is low and a cooling action of the aerial recording sheet carrier 15 is satisfactory, or only the air jet device 32 of the inversion tray 11 may be provided.

We claim:

1. A duplex reproducing apparatus comprising an image forming station, a fixing station and an inversion recording sheet carrying passage, a toner image is generated on a first face of a recording sheet in said image forming station, the toner image being fused, solidified and fixed on the recording sheet in said fixing station, and the recording sheet is turned over through said inversion recording sheet carrying passage and is fed again into said image forming station thereafter to generate a second toner image on a second face of the recording sheet, the second toner image being fused, solidified and fixed on the recording sheet in said fixing station, said duplex reproducing apparatus further comprising support means for carrying the recording sheet from said fixing station while supporting the recording sheet out of contact with any solid members, the support means including means for providing an air stream which carries and cools the recording sheet and the toner image thereon until the toner image on the recording sheet is solidified.

2. A duplex reproducing apparatus according to claim 1, wherein said support means has at least one pair of chambers with wall surfaces facing each other in parallel, and air jets are arrayed on opposite wall surfaces of each pressure chamber.

3. A duplex reproducing apparatus according to claim 2, wherein one pair of said pressure chambers form a recording sheet carrying passage between the parallel wall surfaces of said pressure chambers, and an inversion claw, provided on an outlet portion of said recording sheet carrying passage, is included for guiding the recording sheet and for changing a direction in which the recording sheet runs.

4. A duplex reproducing apparatus according to claim 3, wherein said inversion claw has air jets arrayed on a surface of said inversion claw.

5. A duplex reproducing apparatus according to claim 1, wherein said support means an said inversion recording sheet carrying passage communicate with each other and with each having air jets arrayed on wall surfaces thereof.

6. A duplex reproducing apparatus according to claim 1, wherein said image forming station, said fixing station, and said inversion recording sheet carrying passage form a path for carrying the recording sheet along surfaces of said image forming station, said fixing station and said inversion recording sheet carrying passage.

7. A duplex reproducing apparatus comprising a recording sheet inlet, a forward recording sheet carrying passage, an image forming station, a fixing station having a heat roll and a back-up roll, an inversion claw, an inversion recording sheet carrying passage, an inversion tray, a backward recording sheet carrying passage, a discharge recording sheet carrying passage, and a discharge recording sheet stacking means, the recording sheet having a first face and a second face, a toner image is generated on the first face of the recording sheet in said image forming station, the toner image is fused, solidified and fixed on the recording sheet in said fixing station, and the recording sheet is turned over through said inversion recording sheet carrying passage and is fed again into said image forming station thereafter to generate a second toner image on the second face of the recording sheet, the second toner image being fused, solidified and fixed on the recording sheet in said fixing station, said apparatus further comprising:

an aerial recording sheet carrier disposed between said fixing station and said inversion claw to carry the recording sheet from said fixing station while supporting the recording sheet out of contact with any solid members, the aerial recording sheet carrier including means for providing an air stream which carries and cools the recording sheet and the toner image thereon until the toner image on the recording sheet is solidified.

8. A duplex reproducing apparatus according to claim 7, wherein said aerial recording sheet carrier has at least one pair of pressure chambers with wall surfaces facing each other in parallel, and air jets are arrayed on opposite wall surfaces of each pressure chamber.

9. A duplex reproducing apparatus according to claim 7, wherein said inversion claw has air jets arranged on a surface of said inversion claw.

* * * * *